United States Patent [19]

McBurnie

[11] Patent Number: 4,458,931

[45] Date of Patent: Jul. 10, 1984

[54] ENTRANCE DOOR SECURITY PLATE

[76] Inventor: Walt McBurnie, 764 E. 4825 South, Ogden, Utah 84403

[21] Appl. No.: 389,849

[22] Filed: Jun. 18, 1982

[51] Int. Cl.[3] ..... E05B 17/00

[52] U.S. Cl. ..... 292/346; 70/417; 49/460; 49/504

[58] Field of Search ..... 70/416–418; 292/340, 346, 288, 289; 411/911; D8/331, 343; 49/460, 462, 504; 52/211, 514

[56] References Cited

U.S. PATENT DOCUMENTS 3,377,094 4/1968 Thompson ..... 292/346
3,645,045 2/1972 Gervis et al. ..... 70/417 X
3,976,318 8/1976 Krus ..... 292/346
4,057,275 11/1977 La Beaud ..... 49/504 X

*Primary Examiner*—Thomas J. Holko
*Assistant Examiner*—Thomas J. Dubnicka
*Attorney, Agent, or Firm*—Robert R. Finch

[57] ABSTRACT

A security plate for entrance doors adapted to be secured by tamper resistant fasteners to the stop member of a door frame. The plate is elongated to extend above and below the lock area of the door. The plate has a relatively thick flat edge that abuts a closed door and the plate is formed with a concave portion adajcent the thick edge and connected thereto by a smooth tool-deflecting ramp.

3 Claims, 6 Drawing Figures

ENTRANCE DOOR SECURITY PLATE

FIELD AND BACKGROUND OF THE INVENTION

This invention relates generally to security for buildings and in particular to a low cost device useful with both existing and new installations of lock sets on doors of residences and other buildings.

In the vast majority of locked doors forced entry is relatively simple and may be achieved in a variety of ways. The so-called "credit card" key is simply a piece of flexible plastic that engages the cam surface of a spring loaded bolt causing the bolt to retract from the strike plate opening to unlock the door. Metal tools are also used in this same manner. Some lock sets avoid this problem by the use of a dead bolt that has no angled cam surface. This will defeat the usual plastic card approach, but still leaves the door susceptible to the simple procedure of forcibly removing the strike plate by inserting a screwdriver or other tool into the space between the door edge and the jamb to engage the bolt or the strike plate. The strike plate is then torn loose from the jamb by a sharp blow on the tool. With the strike plate loosened it is a simple matter to push the door open even though the lock bolts are still extended. This is so, because the usual door frame jamb is of soft wood, typically pine, and the strike plate is secured thereto only by light screws that are torn loose with relatively light force. Once the strike plate is loosened, the bolt can be pushed through the soft wood which fractures readily. In a few installations, the door and frame are steel, however, a strong screwdriver or similar tool may still be inserted between the door edge and the jamb at the strike plate or the bolt receiving opening in the jamb if no strike plate is used. The tool is then at a proper angle for the application of force to tear or slice the steel whereupon, even though the lock bolts are still extended (lock position), the door may be swung open. Also, if the stiff tool engages the bolt substantially normal thereto, the bolt can sometimes be sheared by a sharp blow.

The type of forced entry just described is favored by burglars because it is fast, requires few tools and can be accomplished with almost no suspicious movement on the part of the burglar.

SUMMARY AND BRIEF DESCRIPTION OF THE INVENTION

It is the primary object of the present invention to provide a low cost simple security device for use on doors which device blocks entry of either flexible or rigid tools into the area where the locking bolt engages the opening in the strike plate or door jamb.

A directly related object is the provision of a device of the type described that is equally useful on new and existing installations and may be installed by the home owner with only a screwdriver.

A further object is the provision of a security device of the type described that blocks entry to the strike plate and is of a configuration that deflects tools used in an attempt to break the device.

In accordance with my invention the foregoing and probably other objects are achieved by a plate of specific design and adapted to be mounted on the stop portion of the jamb in position to butt against the door face near the edge when the door is closed. The plate is mounted on the door frame, specifically on the stop portion outside the door. By outside is meant the side toward which the door swings to close while inside refers to the side toward which the door swings to open. The term "stop" refers to the element against which the edge of the door face abuts when the door is closed. The stop may be a separate piece on the jamb or it may be milled in the jamb. The plate is elongated and is positioned vertically to extend both above and below the door lock. The plate is of a substantial thickness, at least along the edge abutting the door face so that it overlaps a part of the door face. The plate is mounted on the stop so its edge is in the same plane as the stop edge. That is, very close, almost touching, the face of the closed door. The plate thus positioned prevents entry of a flexible card into the lock bolt area. Also, it prevents insertion of a rigid tool into the lock bolt area unless the door is first gouged out. Gouging the door takes time and requires significant unusual activity, both of which are likely to cause a burglar to abandon his attempt at forcible entry.

If the plate can be broken away adjacent the door, then tools could be inserted. To thwart this, the plate of the invention is formed to render breaking away the edge thereof very difficult, time consuming and obvious. As a feature of the invention, the plate face has a concave portion formed with a sloping or ramp portion along the edge facing the door. The ramp angles away from the door jamb toward the door surface. Thus, a tool placed against the security plate in an attempt to break the plate edge will simply ride up the ramp to hit the door even further away from the strike plate. In this connection, it will be remembered that the burglar seeks to insert the tool into the strike plate area in a direction that is as nearly as possible normal to the door face, the goal being to cause the bolt to retract or to engage the strike plate to tear out the plate so the door may open with the lock bolts still extended. The wood in the jamb is either pushed out by the tool or by the extended bolt.

In order to discourage tool entry from above or below the lock, the plate is sized to extend a distance above and below the lock so that any tool inserted to engage the strike plate will be at such a shallow angle to the vertical or to the door face that even if it engages the strike plate it will not be able to cut it or force it out. This is so, because there is a great deal of frame, wood or metal, above and below the strike plate area and it will be very difficult to dislodge or tear the strike plate with force applied at such an angle.

As noted, the security plate may be applied to existing or new doors. The plate is very simple of construction and easy to install, hence it is a very inexpensive expedient for the homeowner. All that is required is to position the plate on the door stop face outside the door with the edge of the plate abutting the face of the closed door. The plate is secured with one-way screw fasteners that can be removed only with special tools and considerable extra effort and motion thus discouraging the average person seeking quick and unsuspicious forced entry.

The security plate may be made of cast aluminum, brass, iron or steel. The requirements for material of construction being that the plate be durable so that when of practical dimensions, say a thickness, around one quarter inch at the edges, width of two inches and length of six inches, it may be securely fastened with a few fasteners and not be bent. The plate is deliberately formed to have a rugged appearance which is itself a visual deterrent.

In order that the invention may be readily understood and carried into effect, reference is made to the accompanying drawings which are offered by way of example only and not in limitation of the invention the scope of which is defined by the appended claims, including equivalents of elements recited therein, rather than by any preceding description.

DETAILED DESCRIPTION OF THE DRAWINGS

Figure 1:
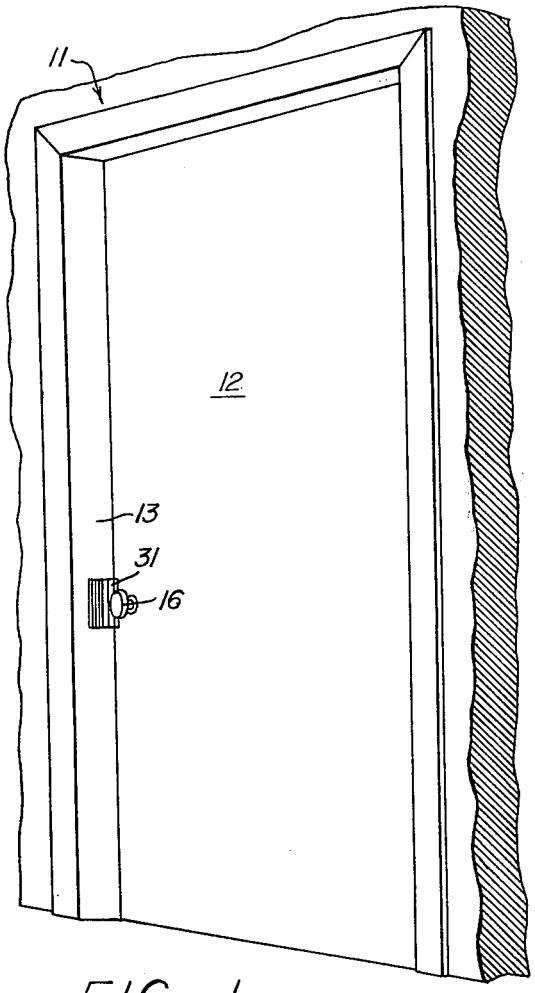
FIG. 1 is a perspective view of a door frame and door assembly with an embodiment of the security plate of the invention in place therein.
Figure 2:
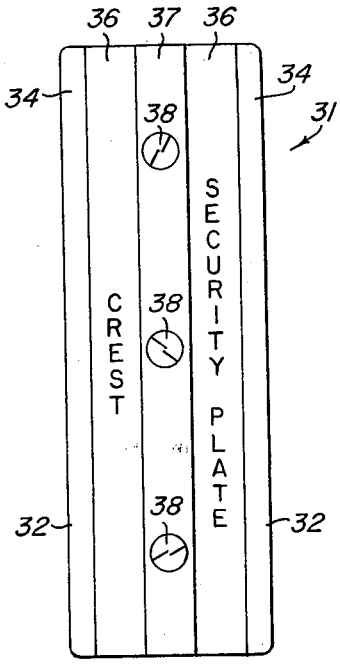
FIG. 2 is a front elevation of the security plate of the invention.
Figure 3:
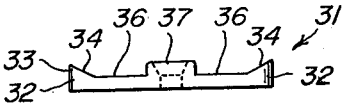
FIG. 3 is a top view of the plate shown in FIG. 2.
Figure 4:
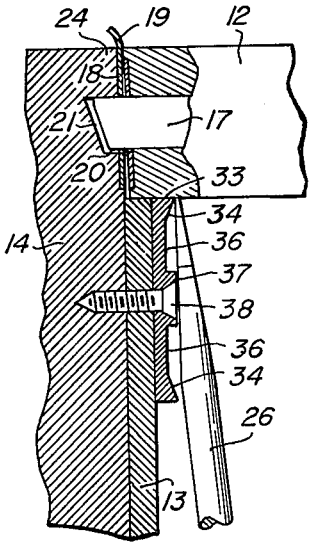
FIG. 4 is an enlarged sectional view of a portion of the assembly shown in FIG. 1 illustrating details of the security plate in position.
Figure 5:
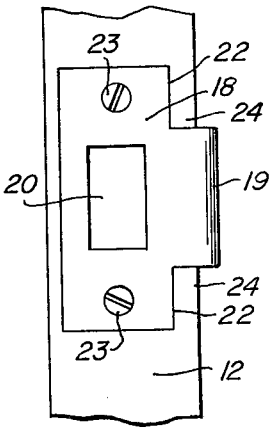
FIG. 5 is an elevational view illustrating a typical strike plate on a jamb.

The drawings illustrate a usual door frame and door assembly that comprises a frame, generally designated 11 to which is hingedly mounted a door 12 that when closed as shown in FIG. 1 butts against a stop 13 secured on or formed as a part of the vertical jamb 14 of the frame (FIG. 4). The door is provided with a usual lock set that includes a knob 16, a bolt 17 and a strike plate 18 that has a curved outer cam or ramp section 19 which the bolt follows to reach the opening 20 in the strike plate where it is spring biased into the opening of the strike plate. As usual, the opening 20 in the strike plate registers with an opening 21 in the jamb that receives the bolt.

Figure 6:
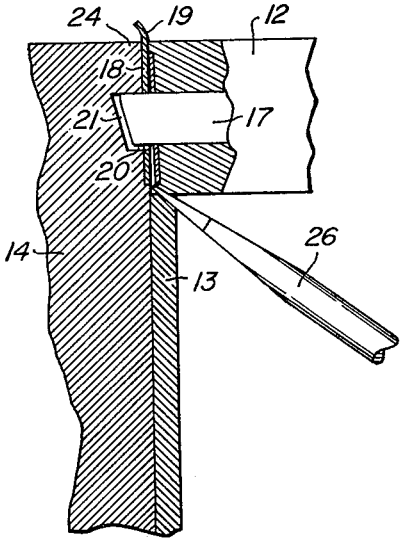
FIG. 6 is a sectional view similar to FIG. 4 but without the security plate of the invention. It illustrates the prior art weaknesses overcome by this invention.

In the usual installation, the strike plate is of thin steel plate and is mounted in a suitable recessed area chiseled or milled in the face of the jamb. The plate is positioned so the approach ramp curves over the jamb edge. When in position, the vertical edge 22 of the plate above and below the ramp are usually no more than one half inch from the vertical edge of the jamb. Typically, the plate is secured to the jamb by relatively small screws 23 which are only intended to hold the plate in place. So long as the plate is in place it helps to hold the door closed by cooperation with the bolt extending therethrough into the recess 21. However, this is not a very secure arrangement. First, as shown in FIG. 6, the plate 18 is vulnerable to forced removal simply by inserting a thin tool, such as a screwdriver 26, into the area between the door edge and jamb to engage the bolt or strike plate edge. A sharp blow on the tool will break away the strike plate and the narrow, thin wood portion 24 of the jamb tearing away the small screws. The door jamb itself is almost always soft wood so that once the steel plate is loosened, the wood can be easily broken by continued pressure on the door. This entire forcible entry can be accomplished by a house breaker quickly and without any noticeable effort.

Obviously, the forcible entry can be made more difficult by securing the plate to the jamb by longer screws or even toggle type bolts in the jamb and/or by reinforcing the jamb so the bolt cannot be broken out, however, these are expensive solutions, especially in existing homes. Probably because of the high cost, these expedients are not often resorted to by the average home owner.

In accordance with the present invention, the strike plate and bolt area of the lock set are protected against forced entry by blocking access of the screw driver or other tool thereby delaying the thief and requiring unusual activity such as kicking or hammering to break out the plate and jamb thus attracting attention.

As shown in the drawings, especially FIGS. 1–5, the security plate, of the invention, comprises an elongated plate 31 of length and width sufficient that when properly positioned on the door stop it extends at least 2–3 inches above and below the bolt of the lockset and a substantial distance away from the door face. This blocks ready access to the strike plate or bolt thus rendering it impossible to tear out the plate or fracture the bolt without unusual activity that would attract attention to the would-be house breaker. The plate should also have a substantial thickness to provide strength; and it should be sized to fit into existing door frames. For the usual residence, a plate two inches by six inches fits well functionally and aesthetically. For strength, the plates should be $\frac{1}{8}$ to $\frac{1}{4}$ inch thick and of a rigid material. I have found a hard cast 380 aluminum to be adequate. The plate has a thickened edge portion 32 that terminates in a flat edge face 33. The plate is thick enough so the flat edge will butt against the closed door face in overlapping relationship to make it impossible for a tool to approach the strike plate at the shallow angle shown in FIG. 6. Thus, with the plate in place, considerable chipping away of the door would be required to access the strike plate or bolt. In this latter connection, it is noted that the plate makes it impossible to strike the bolt itself at a transverse angle as needed to shear the bolt.

It is a feature of my invention that the plate is designed to discourage chipping the edge thereof. In accordance with this feature, the plate is provided with a ramp 34 on its upper face extending at an angle to the top of the side edge against which the door abuts. Thus, if a tool is placed against the plate near the base of the ramp and aimed at a shallow engagement with the strike plate, it will slide up the ramp rather than chip away the plate edge. Since the ramp defines a thickened edge portion the entire plate can be formed as a thin wedge if desired, or it can be flat on the face contacting the stop and have a concave opposite face. I have found the shape shown in the drawings to be especially useful because it is symmetrical to provide a "right side up" for aesthetic reasons regardless of whether the door is right or left handed. In the enbodiment illustrated, there are two thickened edge portions separated by concave sections or channels 36 from a thickened center strip 37. The latter provides a strong base in which the fastening screws 38 seat. For additional security, the screws fastening the plate to the stop should be about one and one half inches and as noted should be the one-way type that cannot be backed out of the hole.

Installation of the security plate is simple. It is placed on the jamb with the long edge against the door and extending equi-distant above and below the bolt and is secured to the stop by one-way tamper proof screws.

From the foregoing it will be evident that the invention provides a simple inexpensive security device that can be readily installed on existing structures to render them impossible to break into without attracting attention to the intruder. The plate can be installed in new construction.

Although the invention has been described with reference to a simple night latch type lock set it is readily adaptable to dead bolt systems. Obviously the plate can be dimensioned to fit various doors.

I claim:

1. For use in a doorway closure of the type that includes a frame, a door hinged to said frame to swing inwardly for opening thereof, and a lock set for securing said door closed, said lockset including a bolt extendable from the free edge of said door and an opening in said frame for receiving said bolt when the door is closed and the bolt extended; a security plate for protecting said bolt and frame against tampering to effect entry, said plate comprising an elongated plate having at least one straight flat-faced edge and adapted to be secured to said frame in position thereon so that when said door is closed said flat face of said staight edge overlaps a portion of said door in closely spaced relationship thereto and extends above and below said bolt, tamper resistant fastener means for securing said plate to said frame, and the edge portion of said plate nearest said flat-faced edge is thickened and the surface of said plate adjacent said edge is bevelled to define on said surface a ramp that angles in a direction toward said edge and away from said surface.

2. A security plate according to claim 1 wherein said plate is an elongated rectangular shape and is thickened along both long side edges, said long edges are flat-faced, and said thickened portions are bevelled to provide a tool deflecting ramp that angles upwardly from said plate toward said door.

3. A security plate according to claim 2 with a thickened center portion located between said side edges for receiving said fastener means.

* * * * *